US006220945B1

(12) United States Patent
Hirokawa et al.

(10) Patent No.: US 6,220,945 B1
(45) Date of Patent: Apr. 24, 2001

(54) POLISHING APPARATUS

(75) Inventors: Kazuto Hirokawa, Chigasaki; Hirokuni Hiyama, Tokyo; Yutaka Wada, Chigasaki; Hisanori Matsuo, Fujisawa, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/296,567

(22) Filed: Apr. 22, 1999

(30) Foreign Application Priority Data

Apr. 24, 1998 (JP) ..... 10-114852
Mar. 29, 1999 (JP) ..... 11-086872

(51) Int. Cl.[7] ..... B24B 29/00
(52) U.S. Cl. ..... 451/287; 451/290; 451/343
(58) Field of Search ..... 451/8, 9, 218, 451/259, 278, 279, 285, 287, 290, 340, 343

(56) References Cited

U.S. PATENT DOCUMENTS 2,546,529 * 3/1951 Speicher ..... 451/343
2,577,042 * 12/1951 Specher ..... 451/343
3,130,523 * 4/1964 Monnet ..... 451/343
5,476,414 * 12/1995 Hirose et al. ..... 451/288
5,514,025 * 5/1996 Hasegawa et al. ..... 451/44
5,562,529 * 10/1996 Kishii et al. ..... 451/36
5,676,025 * 10/1997 Lulay .
5,679,212 * 10/1997 Kato et al. .
5,738,568 * 4/1998 Jurjevic et al. ..... 451/41

FOREIGN PATENT DOCUMENTS 61-168462 7/1986 (JP) .

* cited by examiner

*Primary Examiner*—Timothy V. Eley
(74) *Attorney, Agent, or Firm*—Wenderoth, Lind & Ponack, L.L.P.

(57) ABSTRACT

A polishing apparatus comprises a polishing member that has a wide stable polishing range to perform effective polishing, even if a rotation axis moves away from the edge of a workpiece. A polishing member holder holds the polishing member, and a workpiece holder holds the workpiece to be polished. A drive device produces a relative sliding motion between the polishing member and the workpiece. At least one holder of either the polishing member holder or the workpiece holder is rotatable about a rotation axis and is tiltable with respect to other holder. Such one holder is provided with a pressing mechanism to stabilize orientation or desired posture of the one holder by applying an adjusting pressure to the one holder at a location away from the rotation axis.

24 Claims, 8 Drawing Sheets

POLISHING APPARATUS

BACKGROUND OF THE INVENTION

1. Field of the Invention

The present invention relates to an apparatus for polishing workpieces such as semiconductor wafers, various kinds of hard disks, glass substrates and liquid crystal display panels.

2. Description of the Related Art

In a conventional chemical mechanical polishing (CMP) apparatus used in fabrication of a semiconductor integrated circuit, a semiconductor wafer is held by a holder called a "top ring" and is rotated and pressed against a polishing cloth mounted on a rotating turntable while being supplied with abrading slurry including free abrading grains at a sliding interface. However, such a CMP apparatus presents a problem that, depending on the type of surface patterns and differences in the heights of fine surface structures fabricated on the wafer, it is not possible to obtain a precisely polished flat surface.

Therefore, in place of the above-mentioned CMP process, another CMP technique has been developed, where the wafer is placed in sliding contact with a solid polishing member shaped usually in the form of a plate, in which abrading grains are bound in a matrix, while a polishing liquid or a polishing solution is supplied at the sliding interface. The solid polishing members include variations such as a ring-type member or a cup-type member having abrading pellets distributed in a ring shape.

FIG. 11 illustrates basic movements of a cup-type polishing member. A cup-type polishing member 80 has a ring-shaped abrading member 81 attached on the bottom surface of a polishing member holder 83, and is pressed against a wafer 100 held in a wafer holder 85. Both are rotated, for example, in the same G, H directions, and the wafer 100 is uniformly polished by moving the polishing member 80 linearly in the radial direction of the wafer 100 (indicated by the arrow I) so that the abrading member 81 polishes entire surface of the wafer 100. The polishing member holder 83 is connected to the drive shaft 89 through a spherical bearing 87 so as to transmit a pressing force F from the drive shaft 89 through the spherical bearing 87, and coupling of drive pin 91 passive pin 93 transmits the rotation H from the drive shaft 89.

In general, the polishing member 80 is pressed on the wafer 100 through the drive shaft 89, therefore, when drive axis k of the drive shaft 89 is projected within the wafer 100, as shown in FIG. 11, there is no tilting of the polishing member 80. But, when it is in the position shown in FIG. 12, the rotation axis k projects outside the wafer 100, and even if a part of the abrading member 81 is on the wafer, lever action produces tilting of the abrading member 81 about a fulcrum at the edge of the wafer 100. This prevents the abrading member 81 from having a planar contact with the wafer 100, and polishing becomes impossible. Therefore, to avoid such a situation, conventional abrading member 81 could only move within an area of support for the drive axis k. This problem is the same in a conventional polishing apparatus using a top ring holding the wafer to press it against a polishing table.

SUMMARY OF THE INVENTION

It is an object of the present invention to provide a polishing apparatus using a polishing member that has a wide stable polishing range to perform effective polishing, even if the rotation axis moves away from the edge of a workpiece to be polished.

The object has been achieved in a polishing apparatus comprised by a polishing member holder for holding a polishing member and a workpiece holder for holding a workpiece to be polished; and a drive device to produce a relative sliding motion between the polishing member and the workpiece; wherein at least one holder of either the polishing member holder or the workpiece holder is rotatable about a rotation axis and is tiltable with respect to other holder, and the one holder is provided with a mechanism to stabilize orientation or desired posture of the one holder by applying an adjusting pressure to the one holder at a location away from the rotation axis.

The polishing apparatus of such a construction can maintain a stable contact of the workpiece to be polished to the polishing member at all times to produce stable polishing, even when a projected line of the rotation axis is outside the workpiece to be polished, thereby widening the relative movable range of the polishing member to the workpiece and providing an increased selection for controlling parameters or controlled systems.

DETAILED DESCRIPTION OF THE PREFERRED EMBODIMENTS

Preferred embodiments will be presented with reference to the drawings.

Figure 1:
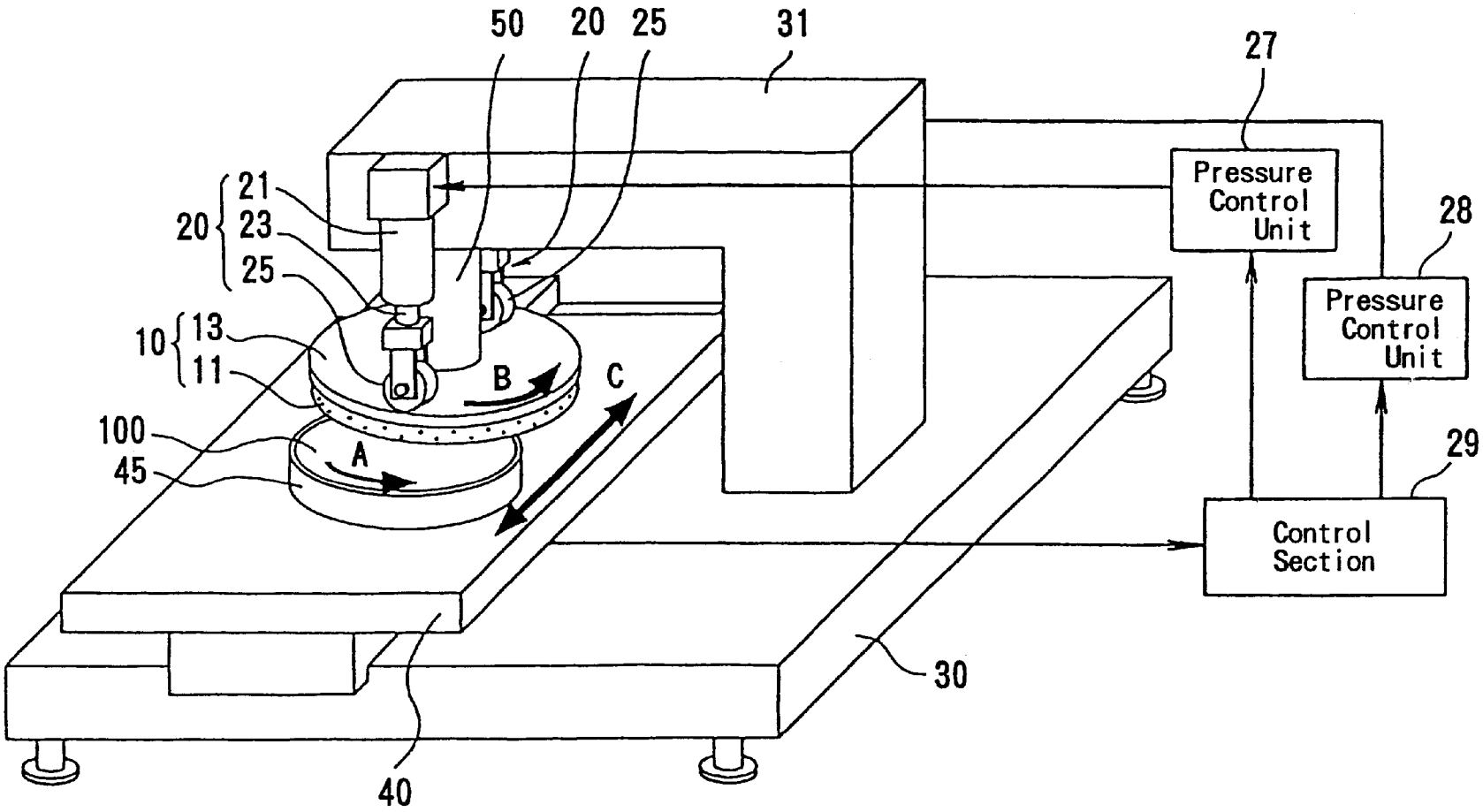
FIG. 1 is a perspective view of a first embodiment of a polishing apparatus.

FIG. 1 shows a perspective view of an overall polishing apparatus having a solid polishing member according to the first embodiment of the present invention. The apparatus comprises a base plate 30; a table 40 moving linearly in the direction C by a drive mechanism (not shown); a wafer holder 45 disposed on the table 40; a polishing member 10 disposed at the end of a drive shaft 50 extending from the bottom surface of a support arm 31.

The wafer holder 45 has a wafer holding section for holding the wafer 100, and is rotated by a drive mechanism provided inside the table 40. The polishing member 10 has a ring-shaped abrading member 11 (or pellet-like abrading member arranged in a ring shape) on the bottom surface of a polishing member support disk (polishing member holder)

Figure 11:
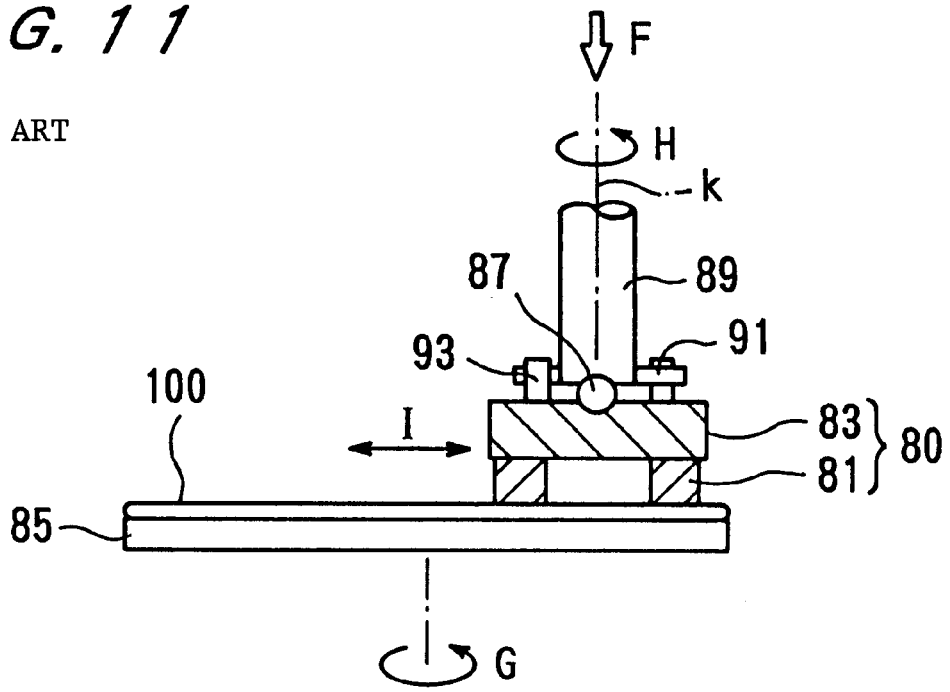
FIG. 11 PRIOR ART
FIG. 11 is an illustration of the action of a conventional polishing apparatus.
Figure 12:
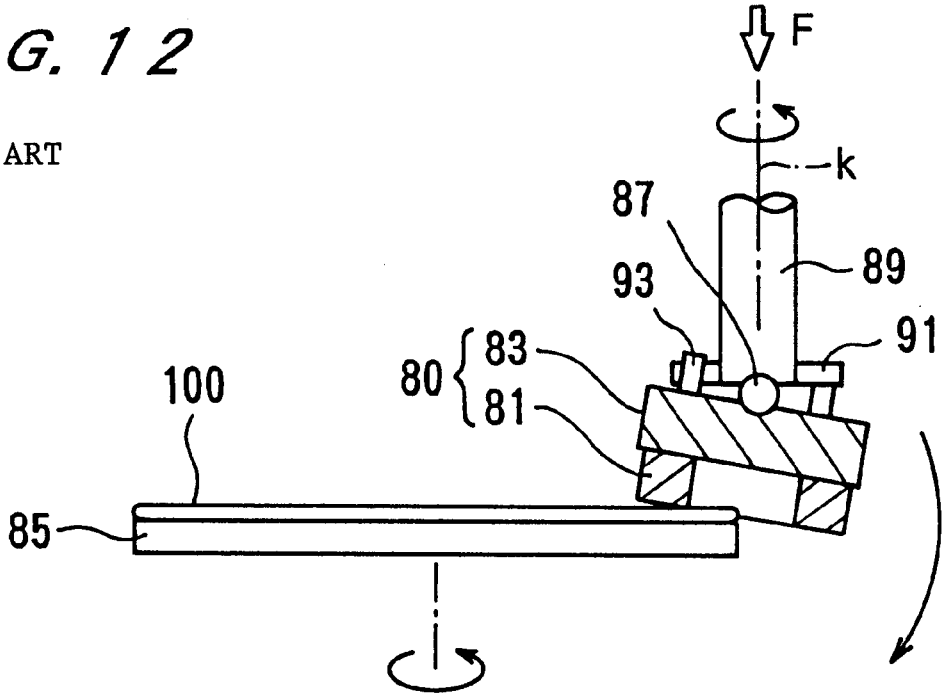
FIG. 12 PRIOR ART
FIG. 12 is an illustration of problems associated with the conventional polishing apparatus.

13, and is rotated by the shaft 50. Between the drive shaft 50 and the polishing member 10, a spherical bearing 52 (FIG. 2A) is provided for transmitting a pressing force from the drive shaft 50 to the polishing member 10. Also, drive pins and passive pins (not shown) are provided for transmitting rotation from the drive shaft 50 to the polishing member 10, as in the conventional polishing apparatus shown in FIGS. 11, 12. The pressure against the wafer is mainly applied by the drive shaft.

On both sides of the shaft 50, pressing devices 20 each having a top end fixed to a side surface at the distal end of the support arm 31 are provided. Each pressing device 20 has a pressing cylinder 21, a rod 23 extending therefrom, and a rotatable roller 25 disposed at the bottom end of the rod 23. The rollers 25 are on the opposite sides of and straddle the rotation axis of the polishing member 10, relative to direction C of linear movement of the polishing member 10, and the rolling surfaces run along the circumferential periphery of the polishing member 10 so as to press on the back surface (top surface in FIG. 1) of the polishing member 10 near its edge. It is permissible to provide one or more than three pressing devices 20.

Pressing cylinders (only one is shown in FIG. 1) 21 have respective pressure control units 27, 28, and share a control section 29 (having CPU and other components) to output control signals for the units 27, 28. Table 40 is provided with position sensors to detect the position of the table 40. A pressing pressure control section is thus comprised by the control section 29, pressure control units 27, 28 and position sensors disposed on the table 40.

The operation of the apparatus will be explained with reference to FIG. 2. First, the wafer holder 45 and the polishing member 10 are independently rotated in the respective A, B directions, and the table 40 is linearly and reciprocatingly moved along the direction C to perform uniform polishing of the overall surface of the wafer 100 with the abrading member 11.

Figure 2A:
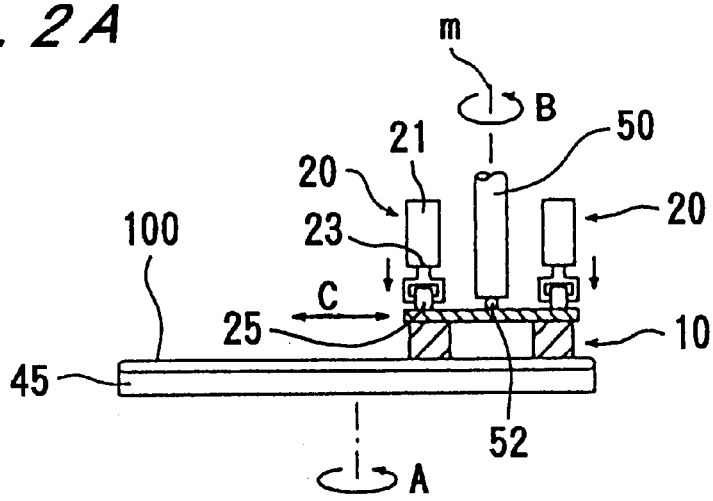
FIGS. 2A~2C are illustrations of the movement of the apparatus shown in FIG. 1.
Figure 2B:
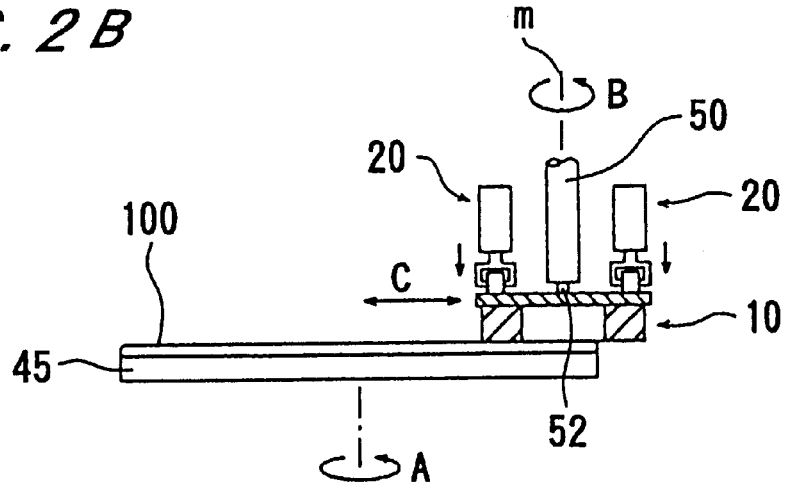

The control section 29 detects the positions of the table 40 and the polishing member 10 according to signals output by the position sensors, and outputs control signals to pressure control units 27, 28. As illustrated in FIG. 2A, not only when the polishing member 10 is entirely situated within the wafer 100, but even when a part of the polishing member is extending out of the wafer 100, as illustrated in FIG. 2B, there is no danger of the polishing member 10 tilting, so that control signals are output in such a way that the pressure control units 27, 28 produce the same pressures.

Figure 2C:
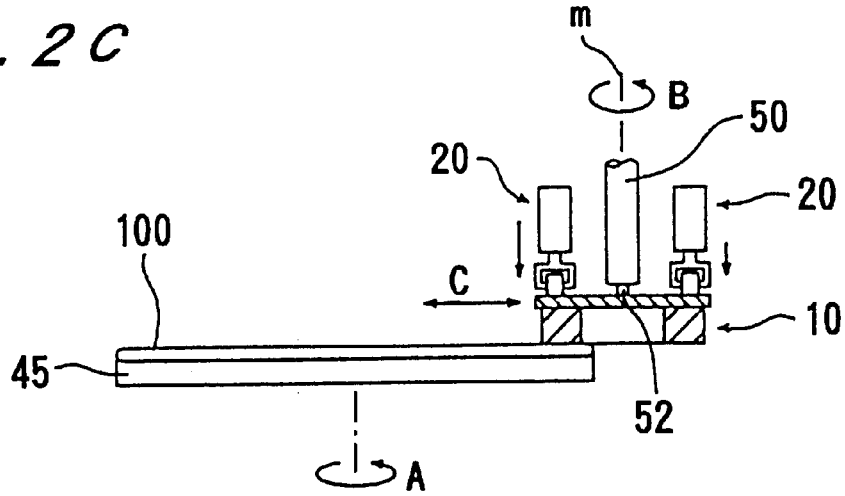

On the other hand, when the control section 29 detects, from the position sensor signals on the table 40, that the rotation axis of the polishing member 10 is outside the periphery of the wafer 100, as illustrated in FIG. 2C, the control section 29 outputs control signals to pressure control units 27, 28 so that they will be outputting different pressures against the polishing member 10 through the respective cylinders 21. In other words, pressing pressure of the pressing device 20 for the on-wafer side is made higher relative to that for the off-wafer side. In this manner, the application point of a balancing or leveling pressure will always be projected on the wafer 100, and there will be no tilting of the polishing member 10. Rotation of the polishing member 10 is not affected adversely by the pressing device 20 because the pressure of cylinders 21 is applied to the back surface of the polishing member 10 through friction reducing rollers 25.

Figure 3A:
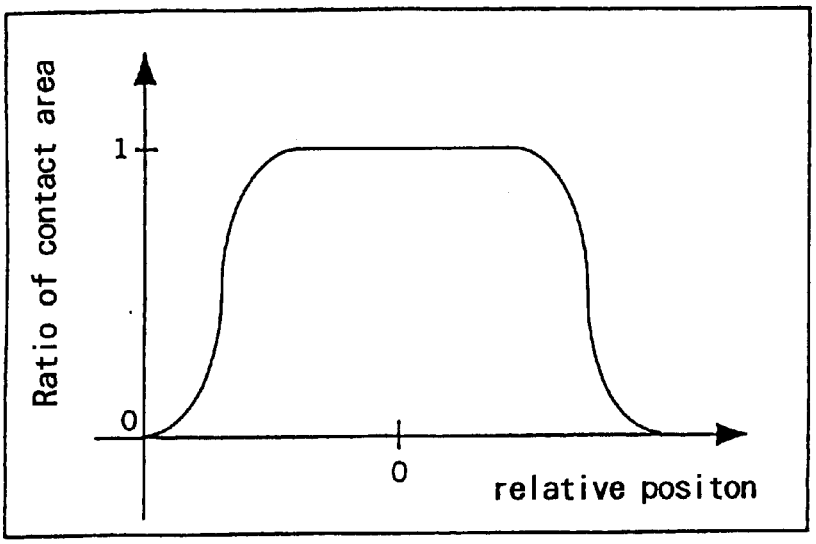
FIGS. 3A~3C are graphs to illustrate pressure mechanisms.
Figure 3B:
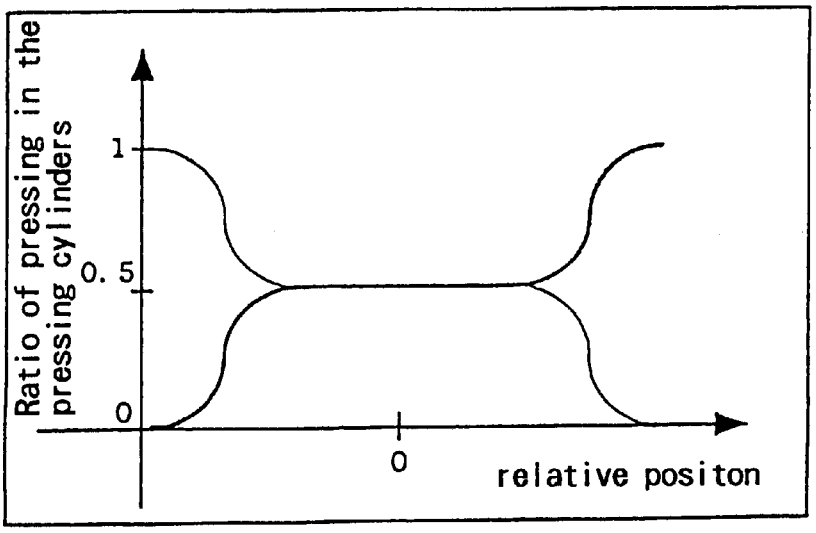
Figure 3C:
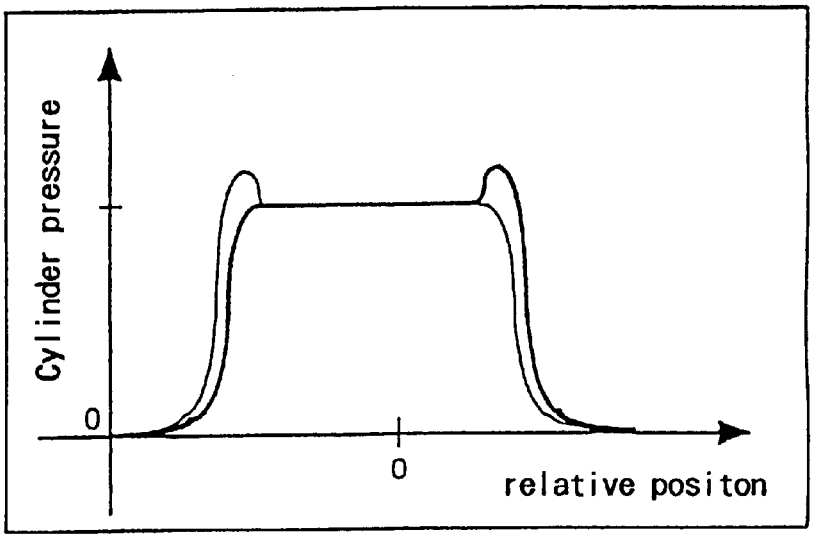

FIGS. 3A~3C show a pressure control methodology using the cylinders 21. The horizontal axis of all the graphs relates to relative positions of wafer and abrading member, and on the vertical axis, FIG. 3A shows ratios of contact area of abrading member to wafer; FIG. 3B shows ratios of pressures in the pressing cylinders; and FIG. 3C shows respective cylinder pressures.

As shown in FIG. 3A, when the rotation axis m of the polishing member 10 is near the central area of the wafer 100, the total surface area of the abrading member 11 is in contact with the wafer 100. When the polishing member 10 moves to the left or the right to overhang from the edge of the wafer 100, the contact area between the abrading member 11 and the wafer changes rapidly. Therefore, in order to maintain the pressure of abrading member 11 on the wafer constant, the pressing force exerted on the polishing member 10 must be reduced accordingly.

As shown in FIG. 3B, when the rotation axis m of the polishing member 10 moves away from the edge of the wafer 100, the off-wafer side pressing device 20 must exert less pressure relative to the on-wafer side pressing device 20. The two pressing devices 20 are operated in such a way that the further the polishing member 10 is away from the edge of the wafer 100 the higher the ratio of the pressures in the two pressing devices 20 so as to maintain a balancing pressure within the wafer 100.

As shown in FIG. 3C, the magnitude of the pressure is maintained the same in each pressing device 20 when the rotation axis m is located within the wafer 100, but as the rotation axis m moves away from the edge of the wafer, the pressure in the on-wafer side pressing device 20 is made higher than that in the off-wafer side pressing device 20. As the rotation axis m moves further away from the edge of the wafer 100, pressures are altered as shown in FIG. 3C, so that the actual magnitude of the pressure will be adjusted according to the ratios of the pressures as seen in FIG. 3B at corresponding relative locations of the abrading member 11 and the wafer 100.

Accordingly, even when the rotation axis m moves off the edge of the wafer 100, it is possible to control the orientation or desired posture of the abrading member 11 to abrade on the wafer 100, thereby expanding the operational range of the polishing member 10.

Figure 4A:
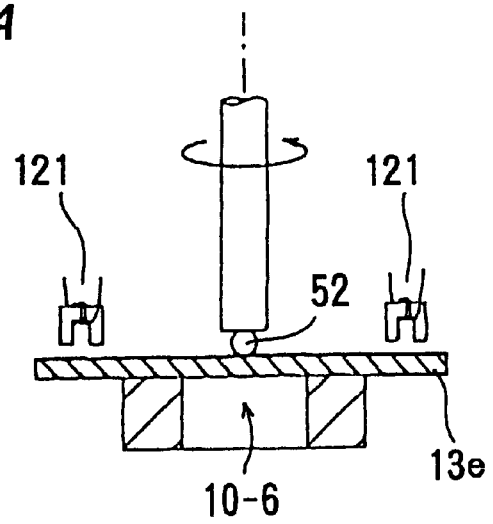
FIGS. 4A~4C are illustrations of a second embodiment.
Figure 4B:
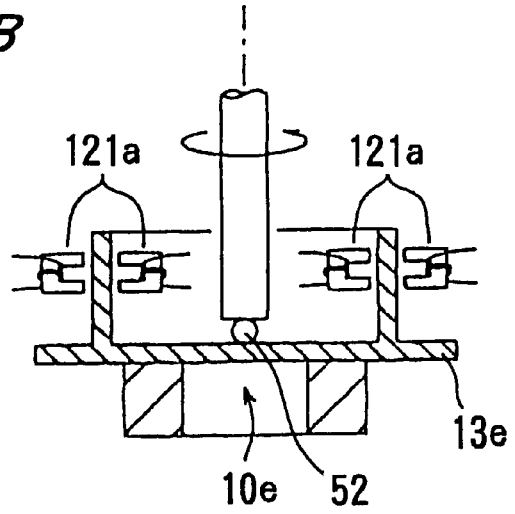
Figure 4C:
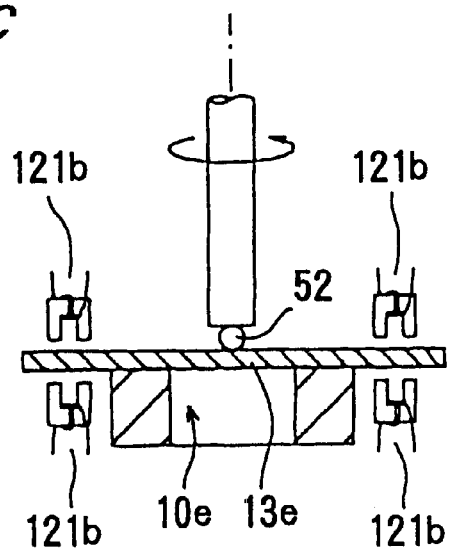

The same effect can be achieved by using magnetic bearings. FIGS. 4A~4C show examples of the use of different types of magnetic bearings. A pair of magnetic bearings 121, 121*a*, 121*b* are used as shown in FIGS. 4A~4C to non-contactingly support abrading member support disk 13*e* to balance the load on polishing member 10*e*. In FIG. 4B, the balancing mechanism is of a cylindrical portion provided on the abrading member support disk 13*e*. Such arrangements of paired magnetic bearings 121, 121*a*, 121*b* are effective in leveling the abrading member support disk 13 and expand the operational control range of the polishing member 10.

Figure 5:
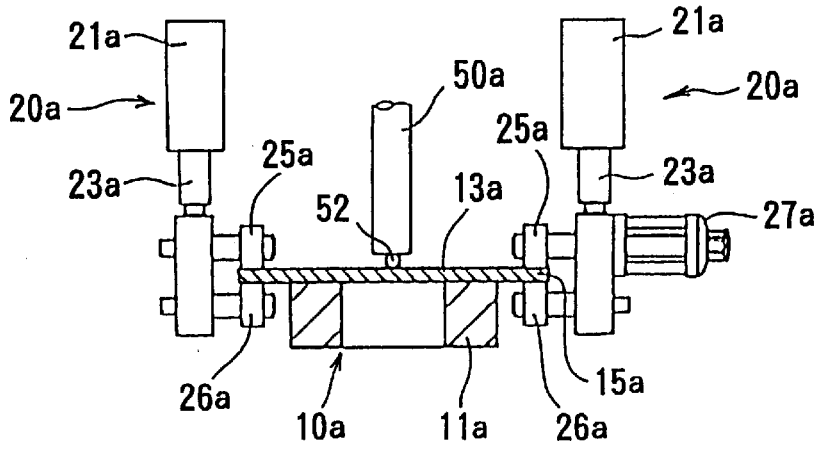
FIG. 5 is a side view of a second embodiment of the polishing apparatus.

FIG. 5 shows essential parts of a second embodiment of polishing member 10*a* and pressing devices 20*a*. This polishing member 10*a* includes an abrading member support disk 13*a* and a ring-shaped abrading member 11*a* (or pellet-like abrading member arranged in a ring shape) and is provided with an outer edge of brim section 15*a* around the circumference of the disk 13*a* that is outside the abrading member 11*a*. In this case, the shaft 50*a* is used only to support the polishing member 10*a* and is not rotated.

The pressing devices 20*a* comprises a pair of upper rollers 25*a* and a pair of lower rollers 26*a*, each provided at the end of a rod 23*a* extending from the bottom of a respective pressing cylinder 21*a*. Left and right pairs of upper and lower rollers 25*a*, 26*a* are used to clamp the brim section 15*a*. One upper roller 25*a* is rotated by an abrading member drive motor 27*a* provided on the outside of the respective pressing device 20*a*.

In this polishing member 10*a*, abrading member drive motor 27*a* is operated to rotate the polishing member 10*a*, and concurrently the pressures of the pressing devices 20*a* are individually adjusted to maintain the polishing member 10*a* in a level position or desired posture even if the rotation axis m of the polishing member 10*a* moves away from the edge of the wafer 100.

Figure 6A:
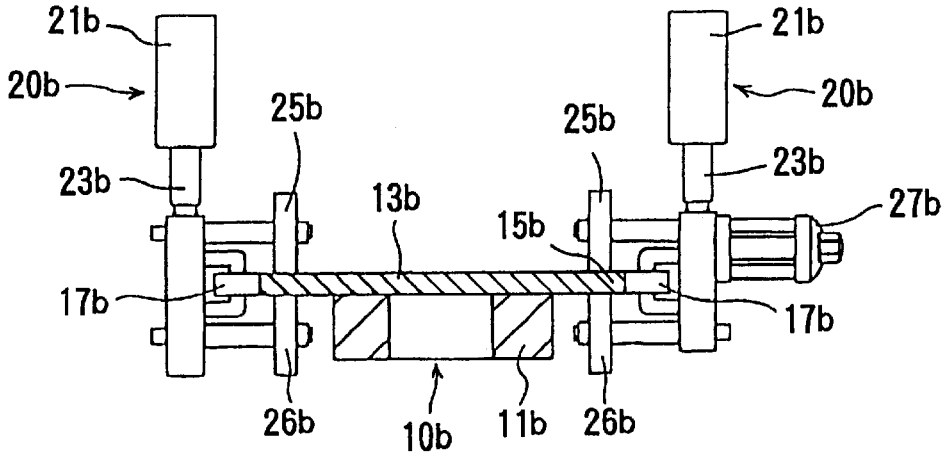
FIGS. 6A, 6B are, respectively, a side view and a plan view of a third embodiment.
Figure 6B:
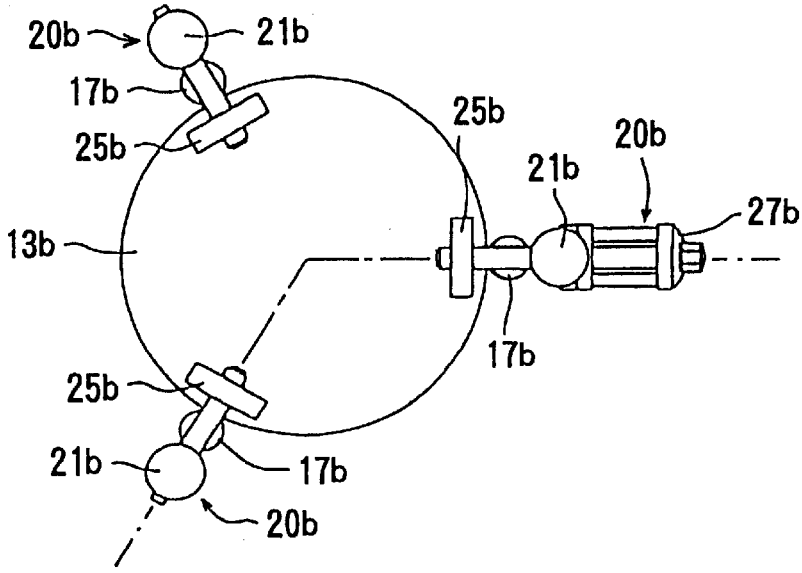

FIGS. 6A, 6B show essential parts of a third embodiment of polishing member 10*b* and three pressing devices 20*b* in a side view in FIG. 6A, and in a plan view in FIG. 6B. The polishing member 10*b* is the same as the polishing member 10*a* shown in FIG. 5, and comprises an abrading member 11*b* attached to the bottom surface of an abrading member support disk 13*b*, and a brim section 15*b* on the edge of the abrading member support disk 13*b*. However, this polishing member 10*b* does not have a shaft 50*a* shown in FIG. 5.

The pressing device 20*b* is also the same as the pressing device 20*a* shown in FIG. 5, and comprises upper and lower rollers 25*b*, 26*b* attached to the end of a rod 23*b* so as to clamp the brim section 15*b*, and one of the pressing rollers 20*b* is provided with a drive motor 27*b*. In this embodiment, each pressing device 20*b* is provided, at the end of the respective rod 23*b*, with an edge guide roller 17*b* to guide the abrading member support disk 13*b*, by contacting the outer vertical periphery of the disk 13*b*.

In effect, the shaft 50*a* for supporting the polishing member 10*a* in the second embodiment is replaced with the edge guide rollers 17*b* in this embodiment. The polishing member 10*b* is rotated by operating the abrading member drive motor 27*b*, and concurrently, individual pressures in the pressing devices 20*b* are adjusted to maintain the polishing member 10*b* in a level position or desired posture even if the rotation axis m of the polishing member 10*b* moves away from the edge of the wafer 100, as in the second embodiment.

Figure 7:
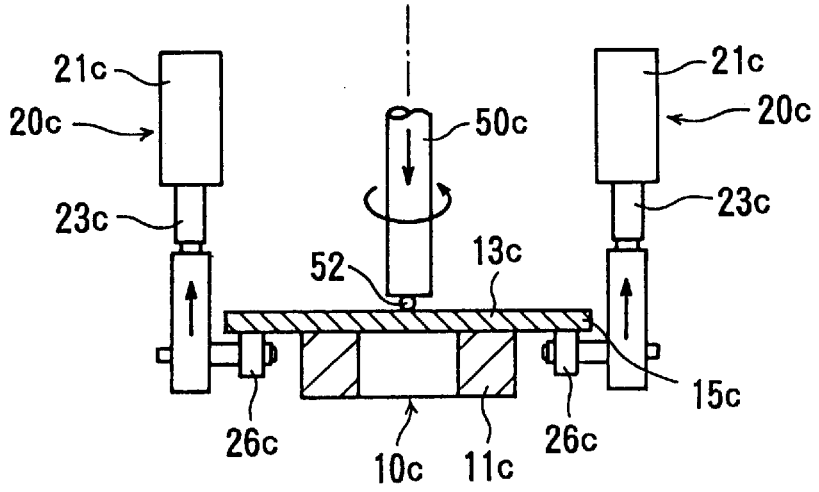
FIG. 7 is a side view of a fourth embodiment of the polishing apparatus.

FIG. 7 shows a schematic side view of pressing devices 20*c* for leveling a polishing member 10*c* in a fourth embodiment. The polishing member 10*c* is the same as the polishing member 10*a* shown in FIG. 5 and comprises an abrading member 11*c* attached to the bottom surface of an abrading member support disk 13*c*, and a brim section 15*c* on the edge of the abrading member support disk 13*c*. In this case, shaft 50*c* supports and rotates the polishing member 10*c*. Each pressing device 20*c* is provided with only a lower roller 26*c* provided at the end of a rod 23*c*, extending from the bottom of a respective pressing cylinder 21*c*, to contact the bottom surface of the brim section 15*c*.

In this embodiment, the polishing member 10*c* is rotated by rotating the shaft 50*c*, and concurrently, each of the pressing devices 20*c* is adjusted to vary the lift force exerted through the rod 23*c* to maintain the polishing member 10*c* in a level position or desired posture even if the rotation axis m of the polishing member 10*c* moves away from the edge of the wafer 100, as in the second embodiment.

Figure 8:
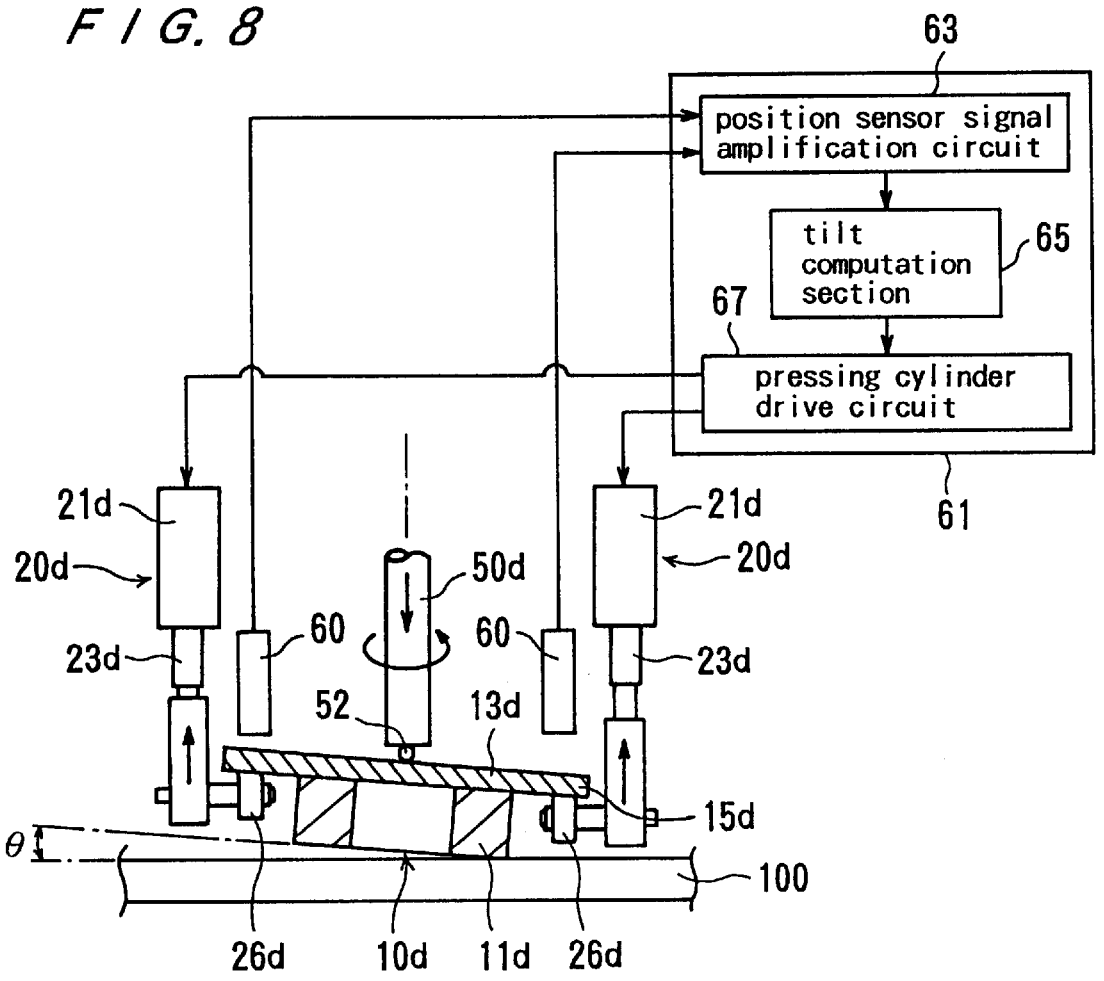
FIG. 8 is a side view of a fifth embodiment of the polishing apparatus.

FIG. 8 shows a schematic side view of pressing device 20*d* for leveling a polishing member 10*d* in a fifth embodiment. The polishing member 10*c* is the same as the polishing member 10*a* shown in FIG. 5 and comprises an abrading member 11*d* attached to the bottom surface of an abrading member support disk 13*d*, and a brim section 15*d* on the edge of the abrading member support disk 13*d* which is rotated with a shaft 50*d*. The pressing device 20*d* is the same as the pressing device 20*c* shown in FIG. 7, and is provided with only a lower roller 26*d* provided at the end of a rod 23*d*, extending from the bottom of a respective pressing cylinder 21*d*, to contact the bottom surface of the brim section 15*d*.

In this embodiment, two position sensors 60 are provided near the edge of the top surface of the polishing member 10*d*, and signals output from the position sensors 60 are input in a position sensor signal amplification circuit 63 in a control device 61, and a pressing cylinder drive circuit 67 outputs control signals to the pressing cylinders 21*d* according to an abrading member tilt computation section 65.

In this embodiment, polishing is performed with the polishing member 10*d* inclined at angle θ to the wafer 100, as shown in FIG. 8. Regardless of the location of the rotation axis m of the polishing member 10*d*, pressure values for the pressing cylinders 21*d* are computed and controlled so that, in this case, the vertical distance between the right position sensor 60 and the polishing member 10*d* is longer than the distance between the left position sensor 60 and the polishing member 10*d*.

Figure 9:
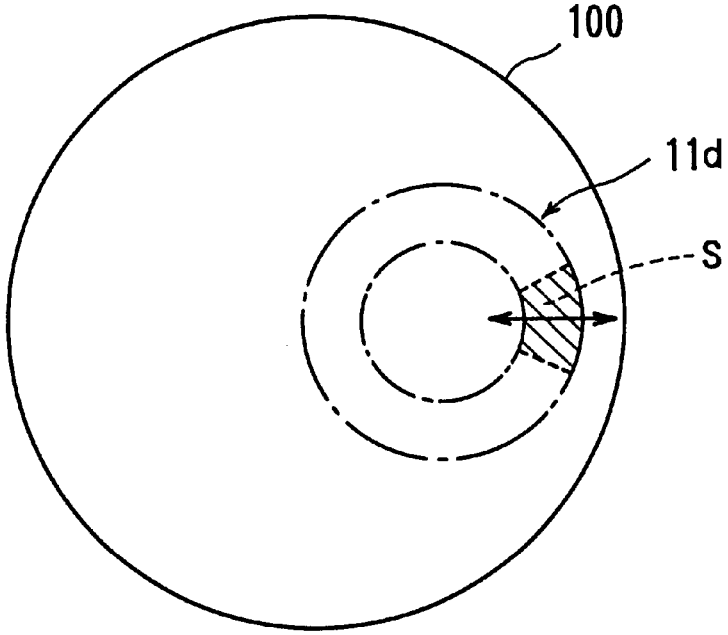
FIG. 9 is an illustration of the contact of a polishing member on a surface of a wafer to be polish.

By controlling the pressing cylinders 21*d* in this manner, the abrading member 11*d* is tilted at a given angle, and moves over the surface of the wafer 100 while maintaining such tilt or desired posture. The reason for tilting the abrading member 11 is as follows. When the abrading member 11*d* is made to contact the wafer 100 at a given angle, as illustrated in FIGS. 8 and 9, because of a specific elasticity of the abrading member 11*d*, contact occurs not over a line contact but over a contact area S. The contact area S is always a specific constant value, no matter where the abrading member 11 is moved over the wafer 100. Therefore, uniform polishing of the entire surface of the wafer may be achieved easily, by controlling the feed speed of the abrading member 11*d*, and because the contact area S is always constant, pressure control is simplified.

In contrast, when the entire abrading surface of the abrading member 11*d* is in contact with the wafer 100, the contact area varies depending on where the abrading member 11*d* is on the wafer so that the control parameters (feed speed for abrading member 11*d* and pressing pressure on abrading member 11*d*) to provide uniform polishing become more complex.

The control method based on position sensors 60 and the control device 61 can be applied to the foregoing first to fourth embodiments. In other words, the method is equally applicable when it is not desired to tilt the polishing member. Also, the above embodiments each utilizes a cup-type abrading member (11, 11*a*, 11*b*, 11*c*, 11*d*), but a disc-type abrading member can be used to produce the same effects.

Locations for applying balancing pressure and the number of pressing devices are not limited to those demonstrated in the foregoing embodiments, and they can be changed to suit each application, for example, the pressing location may only be one location. In the case of first to third embodiments, the abrading member is pushed towards the workpiece to be polished, therefore, when the rotation axis projects off the wafer, it is necessary to press on any area still remaining on the workpiece by lowering the pressing cylinders. On the other hand, in fourth and fifth embodiments, the abrading member is forced to be lifted away from the workpiece so that, when the rotation axis projects off the workpiece, it is necessary to lift any area that is off the workpiece by raising the pressing cylinders. The important point is to adjust the pressing devices in such a way that even though the rotation axis may be off the workpiece, the point of applying a balancing pressure is always projected within the workpiece.

Also, in the fifth embodiment, pressing devices 20*d* were controlled according to position sensors 60, but the pressures of the pressing devices 20*d* can be controlled by using other sensing means such as to directly detect the tilting angle of the cup-type abrading member 10*d*.

In some cases, the conventional CMP process may be applied either before or after the polishing process based on the abrading member according to the present invention.

Figure 10:
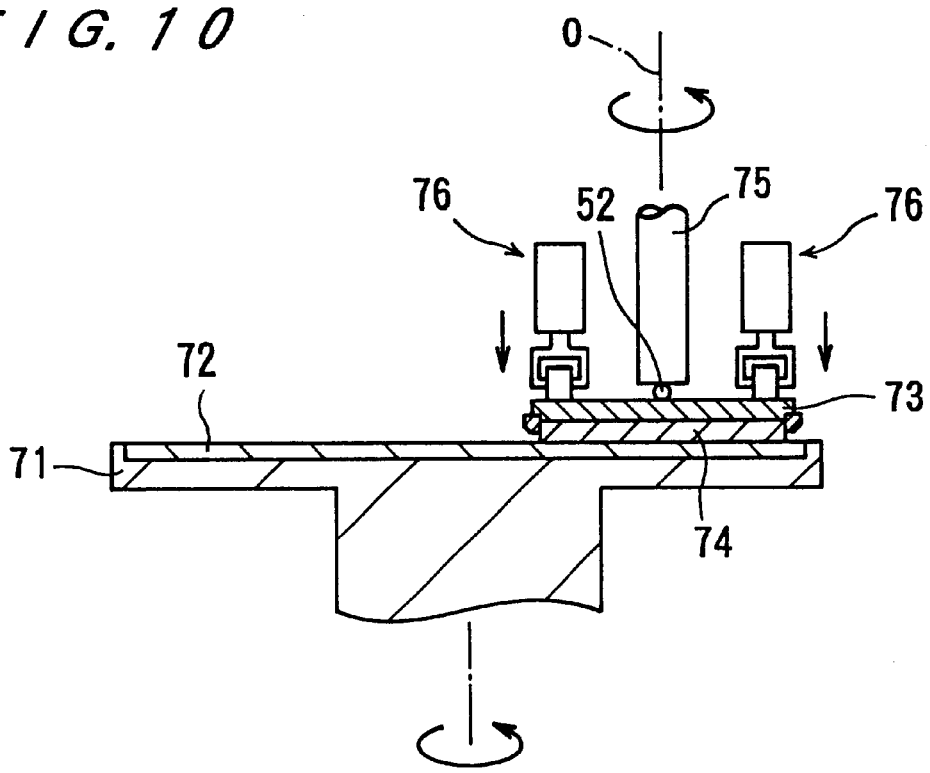
FIG. 10 is a side view of a sixth embodiment of the polishing apparatus.

FIG. 10 shows a schematic side view of a sixth embodiment of the polishing member used in conjunction with a combination of a turntable and a top ring. The polishing apparatus comprises a rotating turntable 71 and a polishing cloth (polishing tool) 72 mounted on top thereof, and a rotating top ring 73 holding a wafer (workpiece) 74 in the bottom section to press against the polishing cloth 72. Polishing is performed using a polishing solution including free abrading grains suspended therein. As in the first embodiment, a pair of pressing devices 76 are provided for balancing purposes so as to straddle the rotation axis o of the top ring 73. In this example, they are disposed symmetrically across the rotation axis o. The pressing devices 76 can be selected from many choices including hydraulic pressure devices based on water or oil or air, and balance control may be achieved by elasticity, piezoelectric controls and others means.

In this case, the top ring 73 is rotated by a rotation shaft 75 and, at the same time, is pressed against the wafer 73 by the two pressing devices 76. This arrangement is effective in providing balanced polishing or desired posture, even when the rotation axis o is off the edge of the table 71, by adjusting the pressures in the pressing devices 76 so as to maintain the projected point of applying a balancing pressure for the top ring 73 within the turntable 7 to prevent tilting of the top ring 73.

Polishing cloth 72 may be replaced a polishing member of various types such as an abrasive stone. Locations of the pressing devices 76 and their designs may be changed to suit each application. The number of pressing devices may be varied from a minimum of one device to more than three devices. Also, the pressing devices 76 may be made in the same manner as those in the second to fifth embodiments.

What is claimed is:

1. A polishing apparatus for polishing a surface of a workpiece, said apparatus comprising:

a workpiece holder to hold a workpiece to be polished;

a polishing member holder to hold a polishing member in opposition to the workpiece;

a polishing pressure applying device to press against each other under pressure confronting surfaces of the workpiece and polishing member;

a drive device to produce relative motion between the confronting surfaces of the workpiece and the polishing member, thus to polish the surface of the workpiece;

a posture control device to maintain one said holder, of said workpiece holder and said polishing member holder, at a desired posture with respect to the other said holder, said one holder being rotatable about a rotation axis; and said posture control device comprises a pressing mechanism to apply an adjusting pressure to said one holder at a location spaced from said rotation axis, said pressing mechanism applying said adjusting pressure sufficient to maintain said desired posture by applying said adjusting pressure at said location on said one holder such that when said location is projected toward said other holder said location would be within the boundary of the workpiece or polishing member held by said other holder, even when said rotation axis, when projected toward said other holder, is outside of such boundary.

2. An apparatus as claimed in claim 1, wherein said desired posture achieves planar contact between the confronting surfaces.

3. An apparatus as claimed in claim 1, wherein said desired posture achieves inclined contact between the confronting surfaces.

4. An apparatus as claimed in claim 1, wherein said pressing mechanism includes a pressure control device to control said adjusting pressure.

5. An apparatus as claimed in claim 4, wherein said pressure control device controls said adjusting pressure to be sufficient to maintain said desired posture to achieve planar contact between the confronting surfaces.

6. An apparatus as claimed in claim 4, wherein said pressure control device adjusts said adjusting pressure to be sufficient to maintain said desired posture to achieve inclined contact between the confronting surfaces.

7. An apparatus as claimed in claim 1, wherein said pressing mechanism comprises a plurality of pressing members spaced about said rotation axis.

8. An apparatus as claimed in claim 7, wherein said pressing members include respective pressing cylinders.

9. An apparatus as claimed in claim 7, wherein said pressing members include respective friction reducing devices.

10. An apparatus as claimed in claim 9, wherein said friction reducing devices comprise rollers.

11. An apparatus as claimed in claim 1, wherein said posture control device comprises a plurality of magnetic bearings to maintain said one holder in said desired posture, said magnetic bearings being out of contact with said one holder.

12. An apparatus as claimed in claim 1, wherein said desired posture achieves planar contact between the confronting surfaces.

13. An apparatus as claimed in claim 1, wherein said desired posture achieves inclined contact between the confronting surfaces.

14. An apparatus as claimed in claim 1, further comprising said polishing member supported on said one holder.

15. An apparatus as claimed in claim 14, wherein said polishing member comprises an abrading member.

16. An apparatus as claimed in claim 15, wherein said abrading member is ring-shaped.

17. An apparatus as claimed in claim 1, wherein said one holder comprises a top ring to support the workpiece to be polished, and further comprising said polishing member supported on said other holder in the form of a polishing table.

18. An apparatus as claimed in claim 17, wherein said polishing member comprises a polishing cloth.

19. An apparatus as claimed in claim 17, wherein said polishing member comprises an abrading member.

20. An apparatus as claimed in claim 1, wherein at least one of said one holder and said other holder are linearly reciprocally movable relative to the other.

21. An apparatus as claimed in claim 1, wherein said posture control device is operated by a signal from a pressure control unit.

22. An apparatus as claimed in claim 21, wherein an inclination of said polishing member is input into said pressure control unit.

23. An apparatus as claimed in claim 1, further comprising a sensor for detecting a position of said polishing member with respect to said workpiece.

24. A polishing apparatus for polishing a surface of a workpiece, comprising:

a first holder for holding a polishing member;

a second holder for holding a workpiece to be polished;

a driving device to produce a relative motion between surfaces of said polishing member and said workpiece;

a pressure applying device to provide pressures between said polishing member and said workpiece to polish said surface of said workpiece;

a control device for maintaining at least one holder of said first holder and said second holder at a desired posture, said one holder being rotatable about a rotation axis; and said control device comprises a pressing mechanism to apply an adjusting pressure to said one holder at a location spaced from said rotation axis, said pressing mechanism applying said adjusting pressure sufficient to maintain said desired posture by applying said adjusting pressure at said location on said one holder such that, when said location is projected toward said other holder said location would be within the boundary of the workpiece or polishing member held by said other holder, even when said rotation axis, when projected toward said other holder, is outside of such boundary.

* * * * *